US011680444B2

(12) United States Patent
Hall et al.

(10) Patent No.: US 11,680,444 B2
(45) Date of Patent: Jun. 20, 2023

(54) LEVELER FOR WINDOW COVERING

(71) Applicant: Hall Labs LLC, Provo, UT (US)

(72) Inventors: David R Hall, Provo, UT (US); Austin Carlson, Mapleton, UT (US); Casey Webb, Spanish Fork, UT (US); Corey Webb, Spanish Fork, UT (US); Jerome Miles, Spanish Fork, UT (US)

(73) Assignee: Medic, Inc., Provo, UT (US)

( * ) Notice: Subject to any disclaimer, the term of this patent is extended or adjusted under 35 U.S.C. 154(b) by 327 days.

(21) Appl. No.: 16/752,185

(22) Filed: Jan. 24, 2020

(65) Prior Publication Data

US 2021/0230938 A1 Jul. 29, 2021

(51) Int. Cl.
*E06B 9/32* (2006.01)

(52) U.S. Cl.
CPC ..... *E06B 9/32* (2013.01)

(58) Field of Classification Search
CPC ... E06B 9/266; E06B 9/50; E06B 9/32; E06B 9/323; E06B 9/42; A47H 1/12; A47H 1/122; A47H 1/124
See application file for complete search history.

(56) References Cited

U.S. PATENT DOCUMENTS

| | | | | |
|---|---|---|---|---|
| 3,306,562 | A * | 2/1967 | Bellefleur | F16M 7/00 248/188.2 |
| 5,584,464 | A * | 12/1996 | Whittaker | F16M 7/00 248/188.2 |
| 7,740,047 | B2 * | 6/2010 | Koop | E06B 9/50 160/323.1 |
| 8,646,738 | B2 * | 2/2014 | Stoob | B64D 11/04 248/188.4 |
| 9,834,983 | B1 * | 12/2017 | Hall | E06B 9/322 |
| 9,869,124 | B2 * | 1/2018 | Hall | E06B 9/326 |
| 2015/0034260 | A1 * | 2/2015 | Blair | E06B 9/50 160/310 |
| 2019/0136615 | A1 * | 5/2019 | Vangberg-Brinkmann | E06B 9/42 |

* cited by examiner

*Primary Examiner* — Daniel P Cahn
*Assistant Examiner* — John W Hanes, Jr.

(57) ABSTRACT

A leveler for a window covering is disclosed. A fixed portion is secured to a headrail of a window casing, and moving portion is secured to the window covering. The moving portion is movable upward and downward relative to the fixed portion to allow for vertical adjustment of one end of the window covering relative to the window casing to straighten the window covering in the window.

7 Claims, 7 Drawing Sheets

LEVELER FOR WINDOW COVERING

TECHNICAL FIELD

The present disclosure is directed to apparatuses, systems, and methods for securing a window covering in a window.

BACKGROUND

The present disclosure is directed to systems and methods for installing shades or other window coverings that are typically installed in windows using mounting brackets that are screwed into the upper corners of window casings. Although effective, this installation technique may require a user to make measurements to ensure that the brackets are installed in the correct locations, as well as require tools (e.g., drills, screwdrivers, etc.) to drive the screws into the window casing. Unfortunately, this installation technique may also leave unsightly holes in the window casing and potentially damage the paint or finish thereon. This installation technique can also be quite time consuming. In a home or building containing many windows to be outfitted with shades or other window coverings, the installation time may increase accordingly. It is also difficult to make adjustments for irregular windows. Frequently windows are not level or square and any departure from level especially at the top can make window coverings slack at one side which is unsightly.

In order to reduce the amount of time or effort needed to install and correct window coverings, installation techniques have been developed. One such technique involves placing spring-loaded mounting brackets at the end of a window covering headrail. When the window covering headrail is placed into a window casing, the spring-loaded mounting brackets are released to provide a compression fit between the window covering and the window casing. Unfortunately, in some cases, such springs may generate insufficient force to secure the window covering to the window casing, particularly with long or heavy window coverings. This can result in movement or creep of the window covering relative to the window casing.

SUMMARY

Embodiments of the present disclosure are directed to a leveler for a window covering including a bracket fixedly coupled to a headrail of the window covering. The bracket has a downwardly extending member with a slot configured to permit vertical movement within the slot. The downwardly extending member includes a track configured to guide vertical movement along the track. The leveler also includes a guillotine member configured to carry the window covering at one end of the window covering, a ramp, and a threaded member. The guillotine member has a ramped shape at a lower edge, resembling a guillotine. The threaded member is held by the bracket in an unthreaded manner to permit the threaded member to rotate relative to the bracket around an axis of the threaded member relative and without translating along the axis relative to the bracket. The ramp is threadably coupled to the threaded member such that rotation of the threaded member causes the ramp to translate relative to the threaded member along the axis of the threaded member. The guillotine member is held within the track of the downwardly extending member and moves upward and downwardly along the track. The ramp and the guillotine member have corresponding ramped surfaces. Rotation of the threaded member causes the ramp to move along the axis of the threaded member, and movement of the ramp along the axis of the threaded member causes the guillotine member to move upwardly and downwardly along the track in the downwardly extending member. Accordingly, rotating the threaded member causes the window covering to move upwardly or downwardly relative to the window casing to level the window covering in the window casing.

In other embodiments the present disclosure is directed to a window covering including a headrail for a window covering spanning a window casing and being secured to the window casing with a lever-operated expandable endcap assembly that presses outwardly against the window casing. The window covering also includes fixed portion coupled to the endcap assembly at one end of the headrail, and a moving portion coupled to the fixed portion and being vertically movable relative to the fixed portion. The window covering is coupled to the moving portion which can be used to adjust a vertical position of the one end of the window covering relative to the headrail.

In still further embodiments the present disclosure is directed to a method for providing an adjustable window covering. The method includes providing a headrail to secure to a window casing, and providing a leveler comprising a fixed portion coupled to the headrail and a moving portion coupled to a window covering. The moving portion is configured to be moved vertically to adjust the window covering by rotating a threaded member within the leveler. The method also includes providing the window covering.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

Figure 1A:
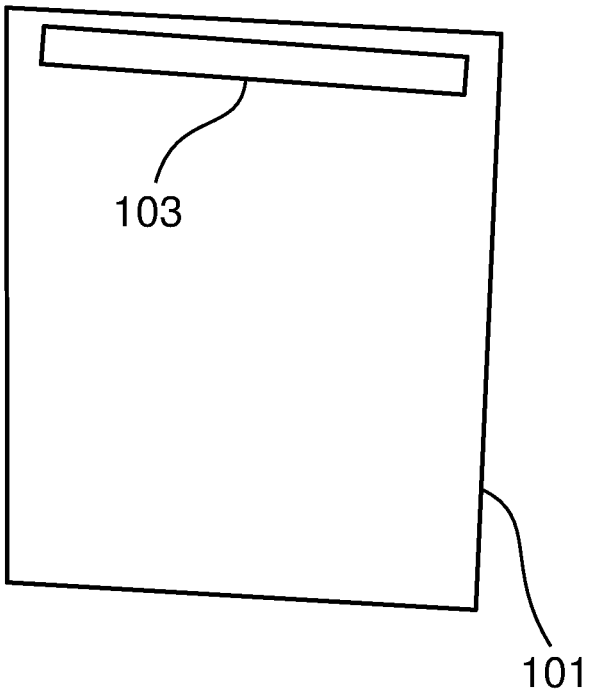
FIGS. 1A and 1B show an irregular window casing and a headrail for a window covering positioned in the window casing according to embodiments of the present disclosure.
Figure 1B:
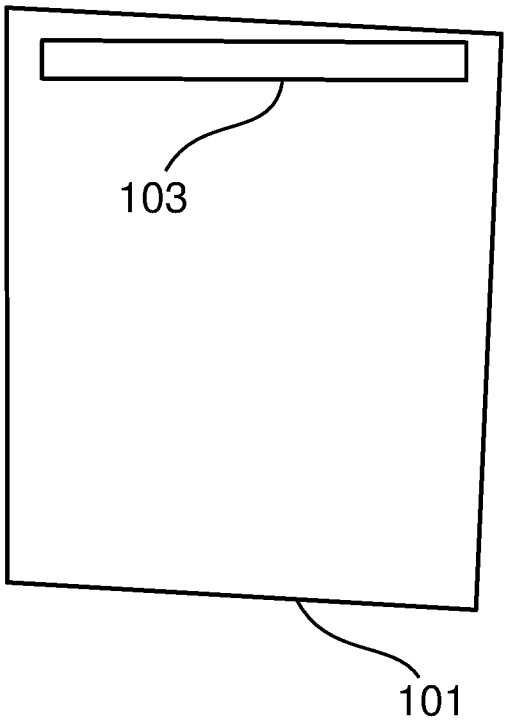

FIGS. 1A and 1B show an irregular window casing 101 and a headrail 103 for a window covering positioned in the window casing 101 according to embodiments of the present disclosure. The window casing 101 is shown here with an irregular shape as is common in many windows, especially older windows which may have sagged over time, been covered with too many coats of paint, or were improperly built in the first place. The top of the window casing 101 is not level, and if the window covering is mounted relative to the irregular window casing 101 without any corrective measures, the headrail 103 will also be crooked as shown in FIG. 1A. The present disclosure is directed to a leveler which will be shown and described herein in greater detail. In FIG. 1B, the leveler has been used to adjust the position of the headrail 103 within the crooked window casing 101 to straighten the window covering.

Figure 2:
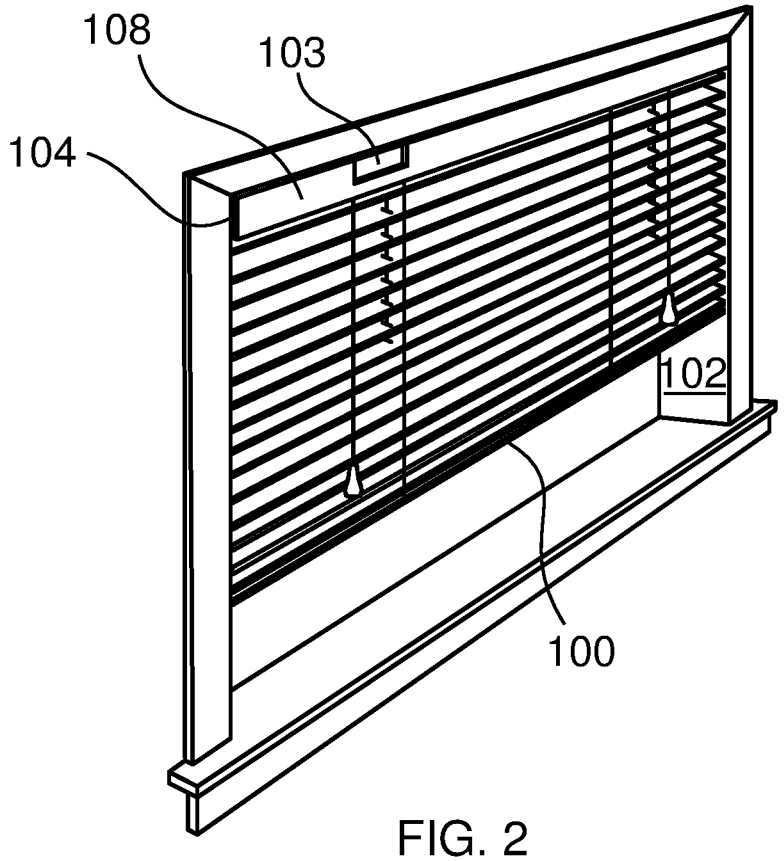
FIG. 2 is a perspective view of one embodiment of a window covering installed using an extensible end cap assembly according to embodiments of the present disclosure.

FIG. 2 is a perspective view showing one embodiment of a window covering 100 installed using an extensible window mounting assembly 104 in accordance with embodiments of the present disclosure. As shown, the window mounting assembly 104 is coupled to an end of a headrail 108 of the window covering 100. The window mounting assembly 104 is configured to retain the window covering 100 within a window casing 102 by creating a compression fit between the headrail 108 and the window casing 102. That is, the extensible window mounting assembly 104 is configured to extend relative to an end of the headrail 108 to create compression against the inside of the window casing 102, thereby retaining the window covering 100 within the window casing 102. Lever 103 may be used to extend and retract a piston portion of end cap assembly in order to create a compression fit between headrail 108 and window casing 102.

Figure 3:
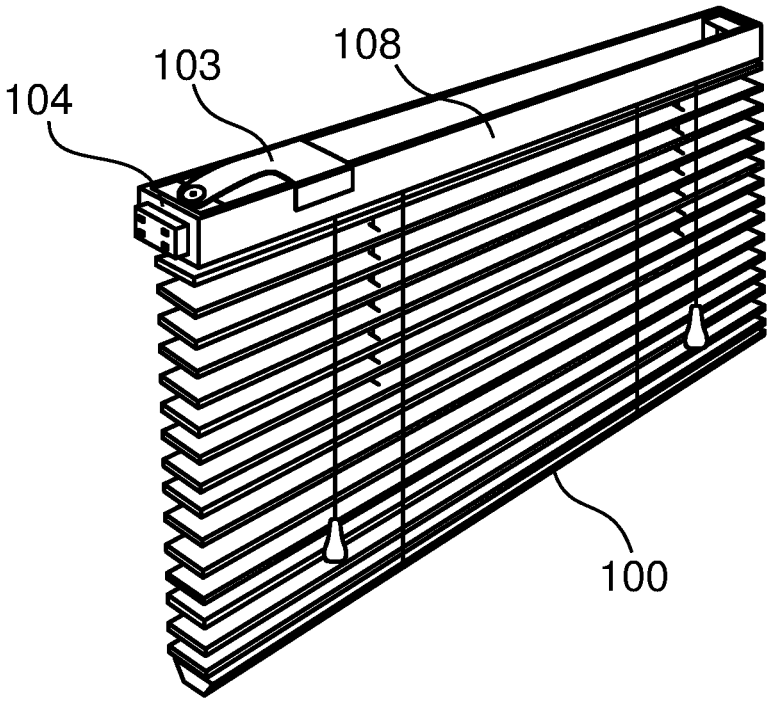
FIG. 3 is a perspective view showing a lever arm for actuating an extensible end cap assembly according to embodiments of the present disclosure.

FIG. 3 shows the window covering 100 removed from the window casing 102, with the extensible window mounting assembly 104 installed in an end thereof according to embodiments of the present disclosure. As shown, the extensible window mounting assembly 104 may, in certain embodiments, slide into an end of the headrail 108. In other embodiments, the extensible window mounting assembly 104 slides over the end of the headrail 108, such as in cases where the end of the headrail 108 is closed. The extensible window mounting assembly 104 may be sized to fit snugly within the headrail 108. The extensible window mounting assembly 104 may also be provided in different sizes to accommodate headrails 108 of different dimensions. In other embodiments, the extensible window mounting assembly 104 may include different adapters to fit different sizes of headrails 108, thereby allowing a uniform-size extensible window mounting assembly 104 to be installed in different size headrails 108. Lever arm 103 may be used to extend and retract a piston portion of end cap assembly in order to create a compression fit between headrail 108 and window casing 102.

Figure 4:
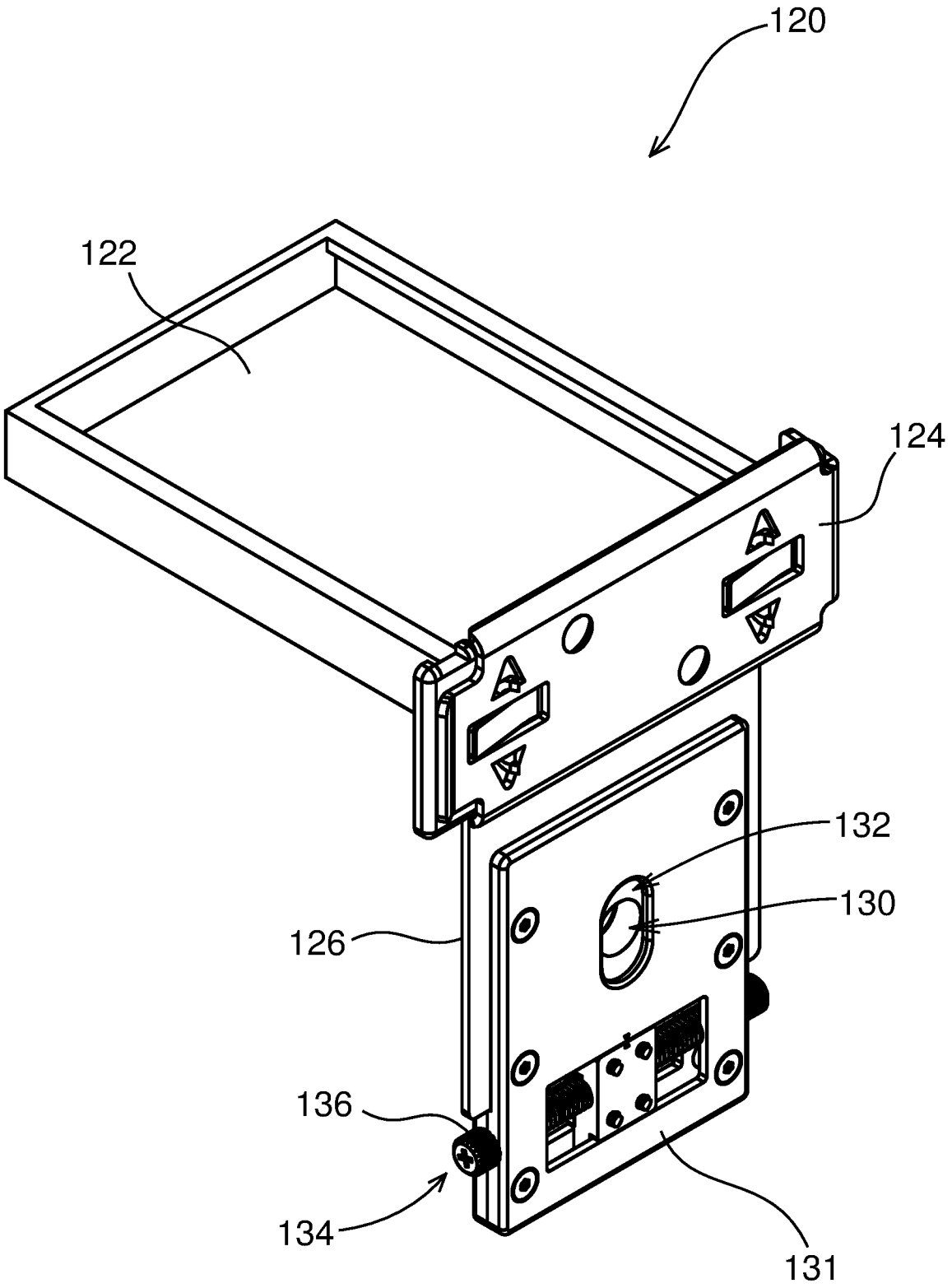
FIG. 4 is an isometric view of a leveler for a window covering according to embodiments of the present disclosure.

FIG. 4 is an isometric view of a leveler 120 for a window covering according to embodiments of the present disclosure. The leveler 120 can be coupled to a window covering at an end portion. In some embodiments the leveler 120 is installed opposite an endcap assembly such as that shown in FIG. 3. The leveler 120 can be used with virtually any window covering mounting. The leveler 120 can include a carriage 122 to secure to the window covering, and an endcap 124 to press against the window casing. The endcap 124 may include an adhesive and/or barbs that will secure the window covering to the window casing. In some embodiments the carriage 122 and endcap 124 are part of the leveler 120; however, in other embodiments these components are part of the window covering and the leveler 120 is secured to the window covering. The leveler 120 can also be used to level other items such as picture frames and other hangings as will become apparent through this disclosure.

The leveler 120 includes a fixed portion 126 and a moving portion 128 that are both generally flat members designed to fit between a window covering and a sidewall of a window casing. The fixed portion 126 is coupled to the carriage 122 and/or endcap 124 and is fixed relative to these items and also to the headrail (not shown). The fixed portion 126 includes a vertical arm 129, a horizontal arm 127 (shown in FIG. 5) and a bracket 131 that is fastened to the vertical arm 129. In some embodiments the vertical arm 129 and bracket 131 can be a unitary piece. The bracket 131 has a slot 132 that is elongated vertically to allow vertical movement.

Figure 6:
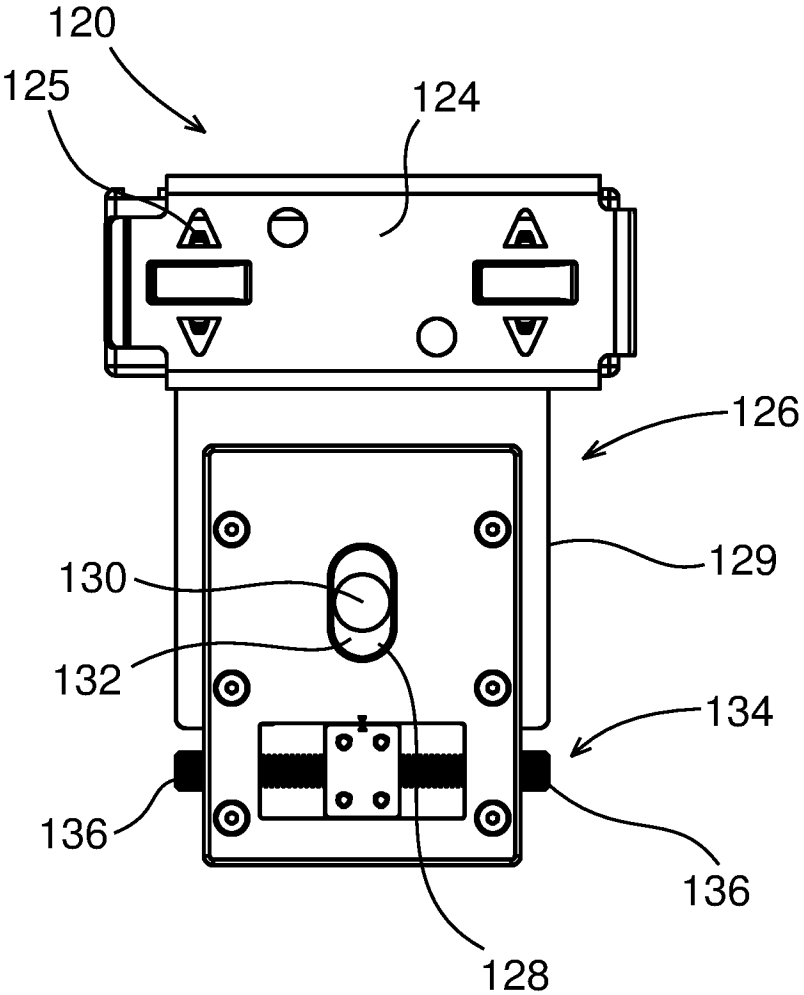
FIG. 6 is an orthographic end view of the leveler according to embodiments of the present disclosure.
Figure 5:
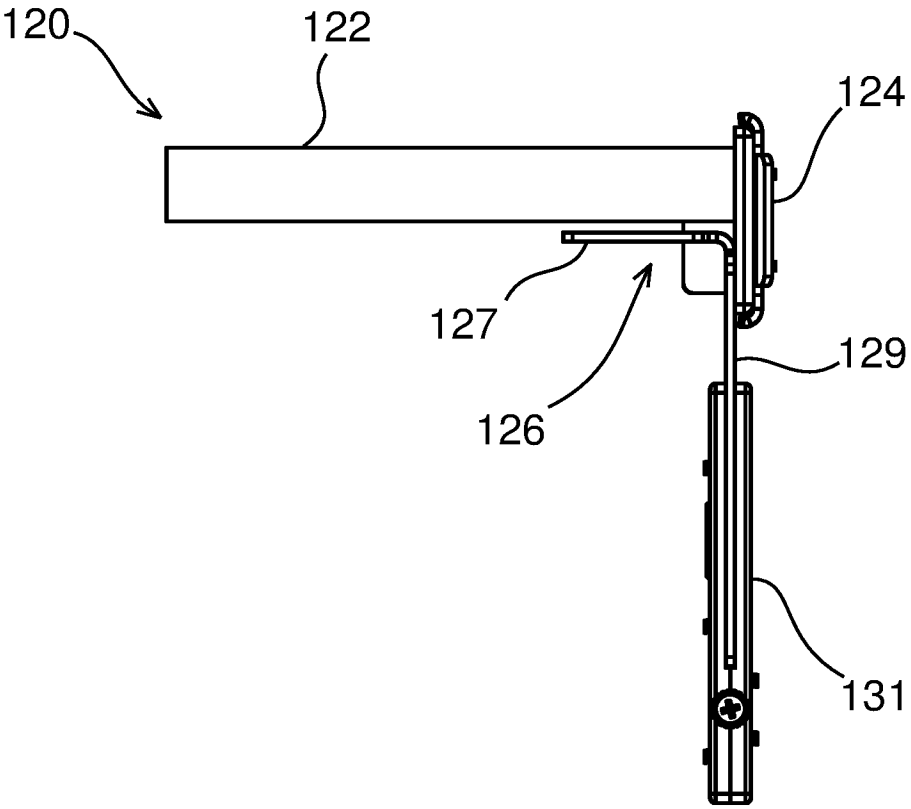
FIG. 5 is an orthographic side view of the leveler according to embodiments of the present disclosure.

The moving portion 128 is partially obscured in FIG. 4 but will be shown to greater advantage in FIGS. 5 and 6. The moving portion 128 includes a generally flat member that resembles a guillotine (shown more clearly in FIG. 8) that sits within the bracket 131 and is movable upward and downward relative to the bracket 131. The moving portion 128 has a hole 130 that carries a roller or other suitable component for a window covering (not shown). The term "roller" will be used herein without loss of generality to refer to a window covering portion that is coupled to the leveler 120. It is to be appreciated that other forms of window coverings may not include rollers, and that other items apart from window coverings may be used with the leveler 120 without departing from the scope of the present disclosure. The moving portion 128 can be moved upward and downward relative to the fixed portion 126 to straighten the window covering.

The moving portion 128 also includes a threaded member 134 coupled to the bracket 131 that has an exposed thumbscrew 136 to allow turning the threaded member 134 to move the guillotine member 128 relative to the fixed portion 126. The thumbscrew 136 on either end may also have a flat or Phillips head screw profile to facilitate turning with a screwdriver or other suitable tool. In some embodiments there is such an accommodation on either end of the threaded member 134. In some embodiments the threaded member 134 does not move axially relative to the leveler 120 as it is turned to make the adjustments and therefore remains within an envelope of the leveler 120.

FIG. 5 is an orthographic view of the leveler 120 according to embodiments of the present disclosure. The carriage 122 and endcap 124 are shown, and the fixed portion 126 is shown coupled to the endcap 124. The fixed portion 126 can in other embodiments be fixed to the carriage 122. In some embodiments the carriage 122 and endcap 124 are a single member. In some embodiments the carriage 122 facilitates coupling with the window covering, but in other embodiments the fixed portion 126 can be sufficiently large to allow for coupling to the window covering without needing a separate carriage component or endcap component. The fixed portion 126 includes a horizontal arm 127 and a vertical arm 129. In some embodiments the horizontal arm 127 and vertical arm 129 are a single unitary piece of metal or other suitable material that is bent such as into an L-shape as shown in FIG. 5. The terms "vertical" and "horizontal" are used in a liberal sense and are not to be construed as limiting these components to a strict vertical or horizontal orientation. The bracket 131 is coupled to the vertical arm 129 with screws or other suitable fasteners. The bracket 131 can be a two-part piece consisting of a front and a back member that "sandwich" the vertical portion 129.

FIG. 6 is an orthographic end view of the leveler 120 according to embodiments of the present disclosure. The endcap 124 is shown with the barbs 125 to secure the assembly to the window casing. The fixed portion 126 can be wide enough to provide strength to the assembly and can be substantially as wide as the window covering. The threaded member 134 is held by the bracket 131 in an unthreaded way to allow the threaded member 134 to rotate relative to the bracket 131 without moving the threaded member 134 along its axis. Rotation of the threaded member 134 causes the upward and downward movement of the leveler 120 by moving the guillotine member 128 and the hole 130 which is fastened to the roller.

Figure 7:
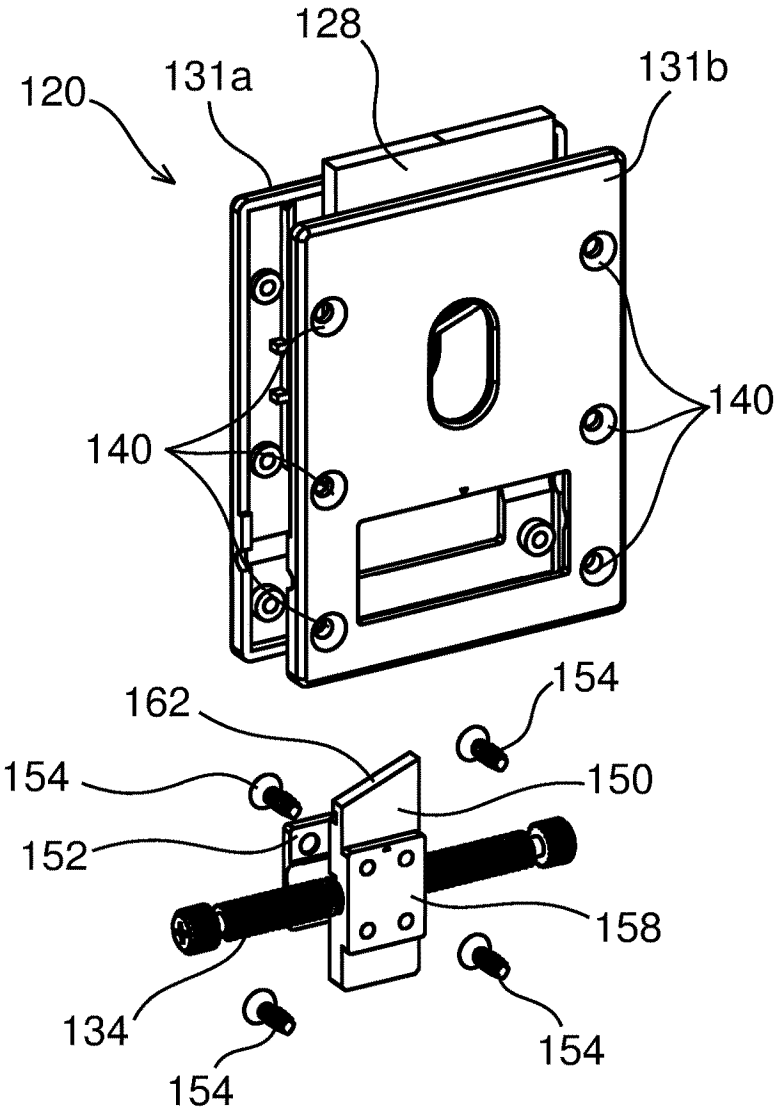
FIG. 7 shows an exploded view of the leveler according to embodiments of the present disclosure.

FIG. 7 shows an exploded view of the leveler 120 according to embodiments of the present disclosure. The bracket 131 consists of two plates 131*a* and 131*b* that are fastened together around the vertical arm 129 (see FIGS. 6 and 8). The bracket 131 has a track 160 at a lower end that defines a horizontal path from left to right that can guide a ramp 150 along the path.

The moving portion 128 can include a ramp 150, the threaded member 134, and the guillotine member 128. The ramp 150 is threadably coupled to the threaded member 134 such that rotation of the threaded member 134 causes the ramp 150 to move left and right along the threaded member 134. The ramp 150 can include a ramp back plate 152 and screws 154 to secure the ramp 150 to the threaded member 134 while allowing the ramp 150 to move along the threaded member 134. The ramp 150 also includes a raised portion 158 that is shaped to protrude into the track 160 of the bracket 131 to maintain the ramp 150 in a generally static orientation as the ramp 150 moves along the threaded member 134 in the track 160. The thickness of the raised portion 158 can also be taken advantage of by the screws 154 and backplate 152. The ramp 150 includes a ramped surface 162 that extends upwardly from the raised portion 158.

Figure 8:
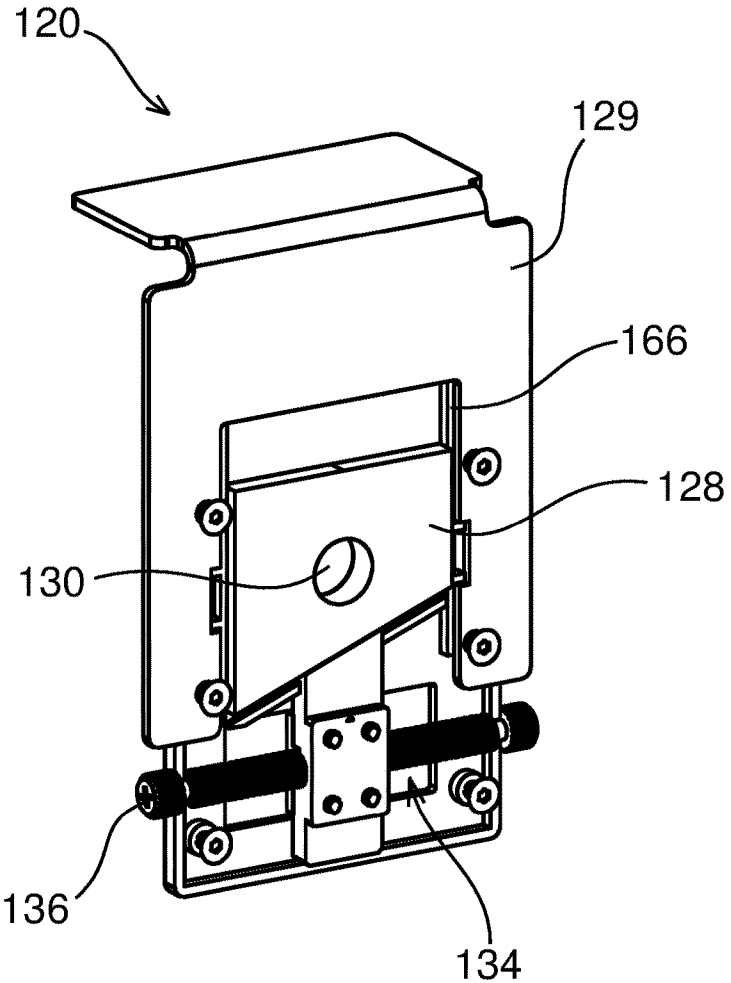
FIG. 8 is an unexploded view of the components of FIG. 7 with a plate of the bracket removed to show interior components according to embodiments of the present disclosure.

FIG. 8 is an unexploded view of the components of FIG. 7 with a plate 131*b* of the bracket 131 removed to show interior components according to embodiments of the present disclosure. The ramp 150 is shown in position relative to the vertical arm 129 of the fixed portion 126. The guillotine member 128 is positioned within the vertical arm 129 and is allowed to slide upward and downward along a track 166 on the vertical arm 129. The lower edge of the guillotine member 128 is ramped, giving it the resemblance of a guillotine. The guillotine member 128 has the hole 130 that has been visible in earlier Figures and that carries the roller. The ramped surface 162 of the ramp 150 and the guillotine member 128 have corresponding slopes such that rotation of the threaded member 134 causes left and right movement of the ramp 150 which in turn raises and lowers the guillotine member 128 in the vertical arm 129. The guillotine member 128 and ramp 150 are keyed together such that the ramped surface 162 both pushes and pulls on the guillotine member 164 to raise and lower the guillotine member 164. In other words, the guillotine member 128 and the ramp 150 are engaged with each having an upward facing and a downward facing surface.

Accordingly, a window covering installed in a crooked window can be righted as shown in FIG. 1B by turning an exposed thumbscrew 136, which moves the ramp 150 which raises or lowers the guillotine member 128 which is fastened to one side of the window covering, allowing vertical adjustment of one side of the window covering to straighten the window covering. In some embodiments a leveler 120 can be installed in either end of a window covering to allow both sides to be adjusted.

Figure 9:
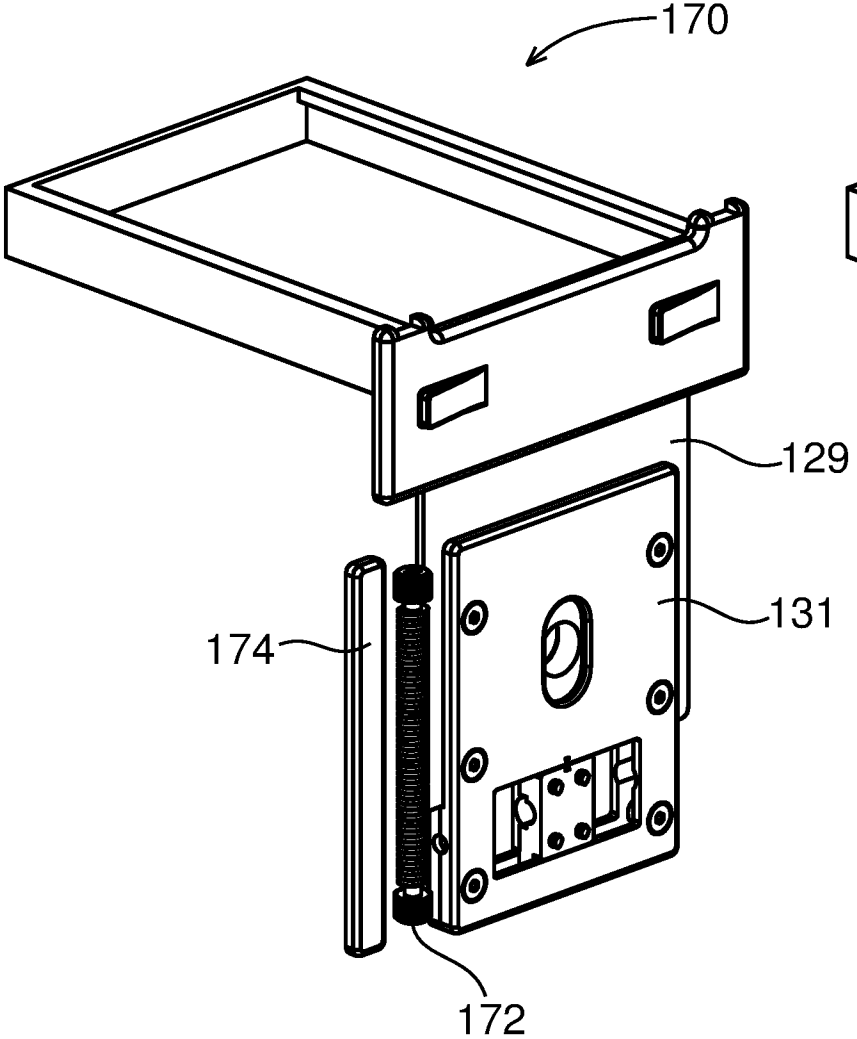
FIG. 9 is an illustration of another embodiment of a leveler for leveling a window covering according the present disclosure.

FIG. 9 is an illustration of another embodiment of a leveler 170 for leveling a window covering according the present disclosure. The leveler 170 can include the bracket 131 which is a generally flat member that is generally parallel with the side of the window casing (not shown). The bracket 131 is coupled to the vertical arm 129 which is also a generally flat member designed to fit between the window covering and the window casing. The leveler 170 also includes a vertical screw 172 that is coupled between the vertical arm 129 and the bracket 131 to allow rotation of the vertical screw 172 to move the bracket 131 up and down relative to the vertical arm 129, thus leveling the window covering. In some embodiments the vertical screw 172 can be rotatably, but not threadably, coupled to one of the vertical arm 129 and the bracket 131 or the other. In other embodiments one of the vertical arm 129 and the bracket 131 can have reverse-pitch threads, and both the vertical arm 129 and bracket 131 are threadably coupled to the vertical screw 172 such that rotation of the vertical screw 172 will move the vertical screw 172 relative to the vertical arm 129, and the bracket 131 relative to the vertical arm 129 and the vertical screw 172. In this embodiment movement of the bracket 131 is double the movement of the vertical screw 172. The vertical screw 172 can be a thumb-screw that is exposed for easy tool-free movement. In some embodiments the vertical screw can be placed at the front of the leveler 170 so it is visible and accessible while the window covering is installed. In some embodiments there can be a cover 174 for the vertical screw 172 to hide it from view.

Figure 10:
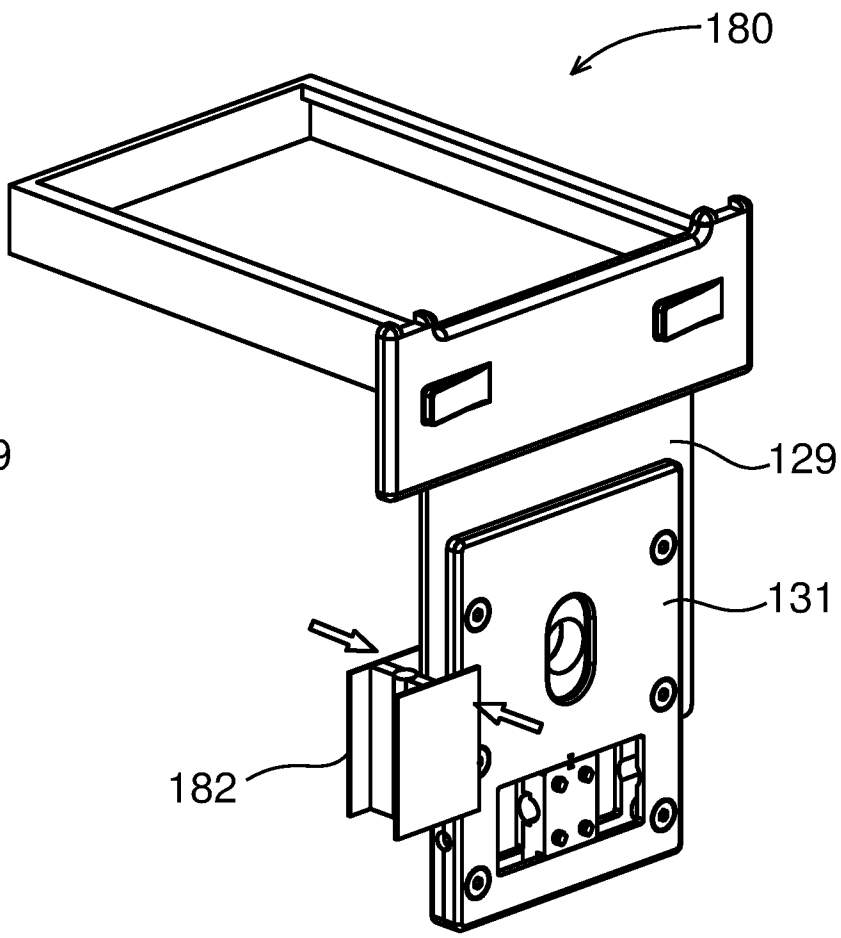
FIG. 10 is another illustration of a leveler according to embodiments of the present disclosure.

FIG. 10 is another illustration of a leveler 180 according to embodiments of the present disclosure. The leveler 180 can have the bracket 131 and vertical arm 129 of FIG. 9. These components are vertically adjustable relative to one another by releasing a clamp 182 that presses the bracket 131 against the vertical arm 129 as shown by the arrows to hold them in place. The clamp 182 can be a hinged clamp or a flexible unitary member or any other suitable means used to hold the bracket 131 and vertical arm 129 together.

Figure 11:
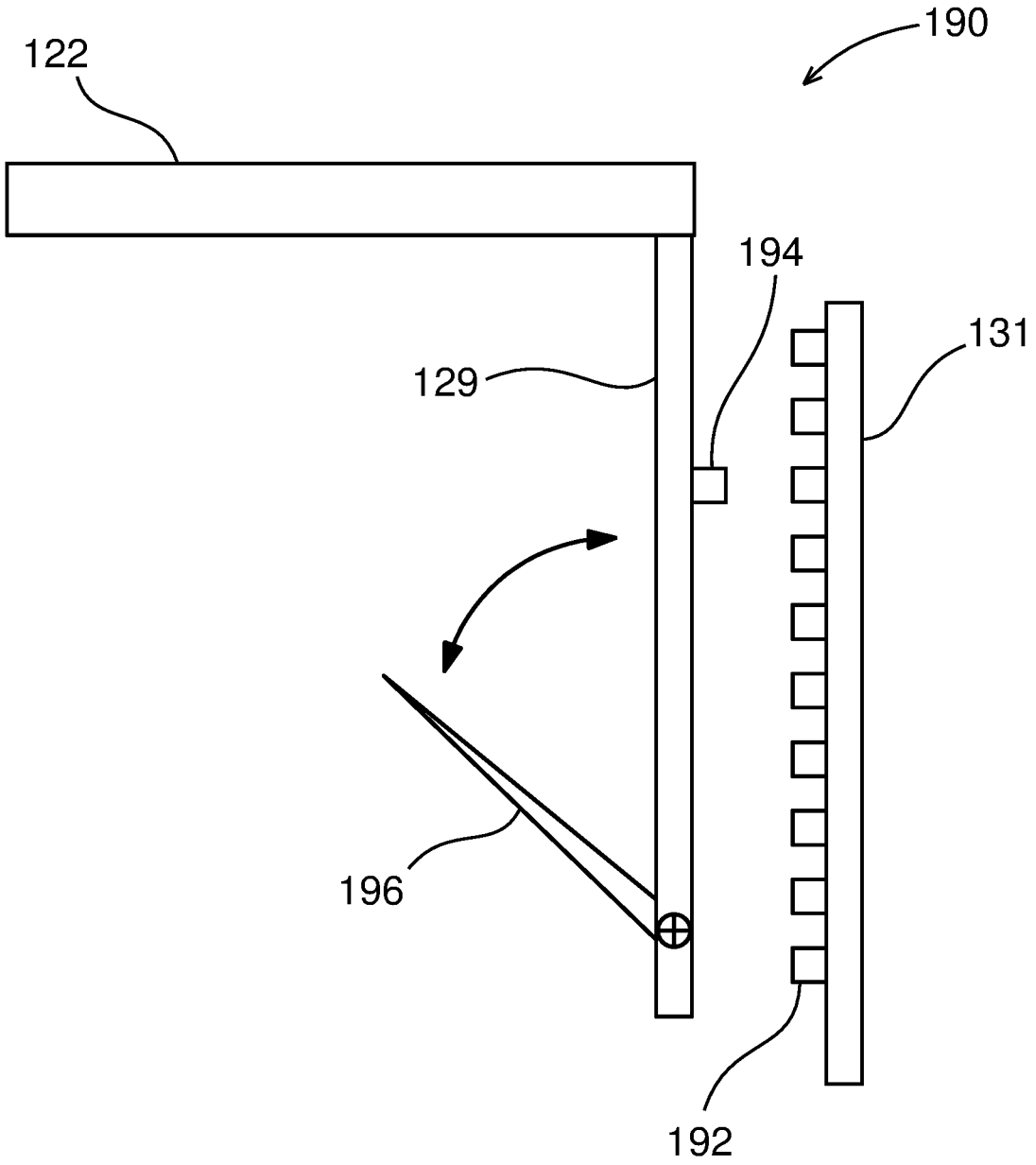
FIG. 11 is yet another illustration of a leveler according to embodiments of the present disclosure.

FIG. 11 is yet another illustration of a leveler 190 according to embodiments of the present disclosure. The leveler 190 includes a carriage 122, a vertical arm 129, and a bracket 131 similar to other embodiments shown herein. The leveler 190 also includes teeth 192 on the bracket 131 and a peg 194 on the vertical arm 129. The teeth 192 define vertical positions for the bracket 131 relative to the vertical arm 129. There can be any number of teeth 192 and the relative size and shape of the teeth 192 and peg 194 can vary. The peg 194 can be friction-fit between the teeth 192, or it can be smaller than the space between the teeth 192 to allow easy installation. In some embodiments the peg 194 is fixed to the vertical arm 29 and permitted to slide horizontally into position between the teeth 192. In some embodiments the peg 194 and teeth 192 form a snap fit. It is to be appreciated that in other embodiments the bracket 131 could carry the peg 194 and the vertical arm 129 could carry the teeth 192.

The leveler 190 includes in some embodiments a lever 196 that is coupled to the vertical arm 129 and rotates relative to the vertical arm 129. Rotating the lever 196 can actuate the peg 194 to enter the teeth 192. The lever 196 can rotate inward from the vertical arm 129, generally in the same plane as the window covering (parallel to the viewing page). In other embodiments the lever 196 can rotate outward toward the room and the viewer. The lever 196 can cause the peg 194 to move or expand or rotate to secure the bracket 131 and vertical arm 129 together. The user releases the lever 196, positions the peg 194 into the teeth 192 at a desired position, and secures the lever 196.

U.S. Pat. No. 9,869,124 is directed to a method of retrofitting a window covering with a motorized tilting assembly and is hereby incorporated by reference in its entirety. U.S. Pat. No. 9,834,983 is directed to an apparatus for automating a set of window blinds and is also hereby incorporated by reference in its entirety.

The foregoing disclosure hereby enables a person of ordinary skill in the art to make and use the disclosed systems without undue experimentation. Certain examples are given to for purposes of explanation and are not given in a limiting manner.

The invention has been described with reference to various specific and preferred embodiments and techniques. Nevertheless, it is understood that many variations and modifications may be made while remaining within the spirit and scope of the invention.

The invention claimed is:

1. A leveler for a window covering, the leveler comprising:

a bracket fixedly coupled to a headrail of the window covering, the bracket having a downwardly extending member with a slot configured to permit vertical movement within the slot, wherein the downwardly extending member includes a track configured to guide vertical movement along the track;

a guillotine member configured to carry the window covering at one end of the window covering;

a ramp; and a threaded member, wherein:

the threaded member is held by the bracket in an unthreaded manner to permit the threaded member to rotate relative to the bracket around an axis of the threaded member relative and without translating along the axis relative to the bracket;

the ramp is threadably coupled to the threaded member such that rotation of the threaded member causes the ramp to translate relative to the threaded member along the axis of the threaded member;

the guillotine member is held within the track of the downwardly extending member and moves upward and downwardly along the track;

the ramp and the guillotine member have corresponding ramped surfaces;

rotation of the threaded member causes the ramp to move along the axis of the threaded member; wherein movement of the ramp along the axis of the threaded member causes the guillotine member to move upwardly and downwardly along the track in the downwardly extending member, such that rotating the threaded member causes the window covering to move upwardly or downwardly relative to a window casing to level the window covering in the window casing; and wherein the guillotine member and the ramp are keyed to one another such that the ramp is configured to push and pull the guillotine member as it is moved along the threaded member.

2. The leveler of claim 1 wherein the guillotine member has a hole configured to carry the window covering with a portion of the window covering protruding through the slot in the bracket.

3. The leveler of claim 1 wherein the bracket further comprises a carriage and an endcap, the carriage being configured to couple to the headrail of the window covering and the endcap being configured to contact a window casing to secure the window covering in the window casing.

4. The leveler of claim 1 wherein the leveler is positioned at a first end of the window covering, and wherein the leveler further comprises a second leveler at an opposite end of the window covering.

5. The leveler of claim 1 wherein the downwardly extending portion comprises a horizontal guide configured to direct the ramp along the threaded member.

6. The leveler of claim 1 wherein the ramp has a slanted surface and the guillotine member has a flat profile contacting the slanted surface.

7. The leveler of claim 1 wherein the guillotine member has a slanted surface and the ramp has a flat profile contacting the slanted surface.

* * * * *